US005902954A

United States Patent [19]

Hetz

[11] Patent Number: 5,902,954

[45] Date of Patent: May 11, 1999

[54] SHAPED CHARGE AND METHOD OF MAKING

[75] Inventor: Avigdor Hetz, Houston, Tex.

[73] Assignee: Western Atlas International, Inc., Houston, Tex.

[21] Appl. No.: 09/135,454

[22] Filed: Aug. 17, 1998

[51] Int. Cl.[6] ..... F42B 1/02

[52] U.S. Cl. ..... 102/307; 102/306; 102/476

[58] Field of Search ..... 102/307, 306, 102/476

[56] References Cited

U.S. PATENT DOCUMENTS

| | | | |
|---|---|---|---|
| 4,776,278 | 10/1988 | Scholles et al. | 102/307 |
| 4,798,145 | 1/1989 | McVeagh | 102/476 |
| 4,951,572 | 8/1990 | Bocker et al. | 102/307 X |
| 5,237,929 | 8/1993 | Ekholm | 102/476 |
| 5,351,622 | 10/1994 | Ekholm | 102/476 |
| 5,505,136 | 4/1996 | Cauchetier et al. | 102/307 X |
| 5,509,357 | 4/1996 | Lawther | 102/307 X |
| 5,567,906 | 10/1996 | Reese | 102/307 X |
| 5,656,791 | 8/1997 | Reese | 102/307 |

FOREIGN PATENT DOCUMENTS

| | | | |
|---|---|---|---|
| 2011144 | 4/1994 | U.S.S.R. | 102/306 |
| 2271415 | 4/1994 | United Kingdom | 102/306 |

*Primary Examiner*—Peter A. Nelson
*Attorney, Agent, or Firm*—Richard A. Fagin

[57] ABSTRACT

The invention is a shaped charge comprising a housing, a liner, a quantity of explosive inside the housing between the housing and the liner, and a retaining spring in contact with the liner and the housing. The retaining spring is positioned to retain the liner substantially immovably inside the housing and has compressed external dimensions to enable locking engagement with the housing. The retaining spring provides axial force against the liner to compress the explosive and prevent shifting and settling of the explosive. The retaining spring also exerts laterally outward force against the circumference of the liner to reduce effects of thermal contraction on the liner. In the preferred embodiment, the retaining spring comprises a bellville spring. The bellville spring has an internal diameter substantially the same as the maximum diameter of the liner to prevent interference with discharge of the detonating shaped charge.

12 Claims, 1 Drawing Sheet

SHAPED CHARGE AND METHOD OF MAKING

BACKGROUND OF THE INVENTION

1. Field of the Invention

The invention is related to the field of shaped explosive charges used for oil well perforating. More specifically, the invention is a high-explosive shaped charge having an improved liner retention feature, and a method for making the improved high-explosive shaped charge.

2. Description of the Related Art

High-explosive shaped charges are used for, among other purposes, perforating steel casing cemented into wellbores drilled through the earth for extracting oil and gas. Shaped charges known in the art typically include a quantity of powdered high explosive, such as those known by trade names RDX or HMX, inserted into a housing. Some shaped charges can include an acceleration explosive disposed on one side of the housing for increasing the probability of detonation of the high explosive when a detonating signal is applied to the outside of the housing. The detonating signal is usually conducted through a detonating cord placed in contact with the side of the housing opposite to the intended detonation direction. The detonating cord is itself typically filled with high explosive similar to that used in the shaped charge and can be initiated by a blasting cap, exploding bridge wire or similar detonator. A liner is positioned in contact with the high explosive, opposite to the acceleration explosive, inside the housing. The liner is generally conically shaped and can be composed of powdered metal, such as copper and lead, formed by compression under extremely high pressure so as to behave substantially as a solid. See for example U.S. Pat. No. 4,794,990 issued to Riggs which describes the process of compressing the liner material into a finished liner.

When the high explosive is detonated it generates extremely high pressures and temperatures which cause the liner to discharge from the other side of the housing in a predetermined pattern, which is typically in the shape of a very narrow cone or "jet". The jet moves away from the housing at very high velocity, thereby generating the perforation in the wellbore by means of the kinetic energy of the jet. The force of the jet typically can penetrate a ½ inch thick steel casing inserted into the wellbore and cement surrounding the casing before penetrating several inches of earth formation.

As is known in the art, the performance of the shaped charge can be dependent on the shape of the liner, the position of the liner within the housing, and uniformity of contact between the high explosive and the liner. The performance of any individual shaped charge depends on the liner and the high explosive remaining in their correct relative positions even after handling and transportation of the shaped charge to the wellbore. The shock and vibration of transport, as well as thermal cycling during storage, sometimes cause mispositioning of the liner, the explosive, or both.

Several methods are known in the art to prevent shifting or settling of the explosive and to prevent movement of the liner. Referring to FIG. 1, which shows a typical shaped charge known in the art, a bonding agent 6 can be applied to the surface of the liner 4 which is placed in contact with the high explosive powder 8, in order to improve cohesion between the liner 4 and the explosive 8. Bonding agents can be difficult and expensive to apply to the liner 4, and can substantially increase the cost of making a shaped charge.

It is also known in the art to apply an adhesive, as shown at 10, to the discharge side of the liner 4 on its circumference, in order to bond the liner 4 to the inside wall of the housing 2. The adhesive 10 prevents movement of the liner 4 relative to the housing 2. The adhesive used for bonding the liner 4 to the housing 2 typically is of a type which can be cured by exposure to ultraviolet light. Use of the adhesive known in the art to bond the liner 4 to the housing 2 can be difficult and expensive, particularly because use of adhesive requires the additional step of removing or "dusting off" excess high explosive powder 8 which may be present on the part of surface of the housing 2 to which the adhesive is to be bonded.

U.S. Pat. No. 5,237,929 issued to Ekholm suggests interference fit of a retainer ring to prevent movement of the liner. The retainer ring shown in the Ekholm '929 patent includes protrusions for shaping the discharged "jet" into a special pattern, but the protrusions do not affect the liner retention aspect of the retainer ring. A difficulty in using any type of interference fit device to retain the liner is that thermal expansion can cause the retainer ring to become loose and allow the liner to move. Thermal expansion is a particular issue with oil well perforating charges because the temperature in a wellbore can easily exceed 300° F. at the intended perforating depth. Interference fit liner retaining rings have therefore proven unsuitable for use in oil well perforating charges.

U.S. Pat. No. 5,351,622 issued to Ekholm discloses a resilient retainer to prevent movement of the liner. The resilient retainer described by Ekholm has several drawbacks. The housing requires a groove in order to better restrain the resilient retainer from axial movement. Providing a groove can increase the overall cost and complexity of the shaped charge. Further, for safety reasons, any groove in the housing would have to be thoroughly cleaned before inserting the resilient retainer to avoid accidental detonation of any explosive which might be deposited in the groove during manufacture of the shaped charge. The Ekholm '622 patent in fact describes the shaped charge as preferably being filled with high explosive through an opening in the rear of the housing (the side opposite the intended discharge) after insertion of the assembled liner and resilient retainer into the groove in the housing. Such "back-loaded" shaped charges are more difficult and expensive to make than the "front loaded" charges (those loaded through the discharge side) more commonly used in oil well perforating, primarily because the necessary opening in the rear of the housing would have to be plugged in a separate operation, requiring some type of plug to close the opening. The resilient retainer described in the Ekholm '622 patent prevents the liner from moving laterally by the spring force exerted by the retainer ring, but the retainer ring does not provide any spring force in a direction parallel to the discharge of the jet. It is possible for the high explosive in a shaped charge made according to the Ekholm '622 patent to settle and shift during transport and movement into a wellbore, unless the explosive is tightly packed against the liner. Back-loading the shaped charge as described in the Ekholm '622 patent would make packing the high explosive difficult because the small opening in the rear of the housing makes it impracticable to insert a suitable ram or packing device into the housing which could make contact with the high explosive across the entire area bounded by the liner.

Another type of retainer for the liner in a shaped charge is shown in U.S. Pat. No. 4,798,145 issued to McVeagh. The retainer shown in this patent comprises a spring washer which axially compresses the liner against the explosive.

The spring washer disclosed by McVeagh has several drawbacks. First, the spring washer is fairly long, even when fully compressed against the liner. This length means that the shaped charge housing has to extend axially outward from the open end of the liner enough to provide a seat for gripping teeth on the outer end of the spring. According to the McVeagh '145 patent, the spring washer is relatively long so that a "bowed in" portion (shown at numeral 9 in FIG. 5 of the McVeagh '145 patent) will not interfere with the discharge from the detonating shaped charge. The required length of the spring washer and the housing makes it difficult to place the shaped charge in close contact with its target, as is frequently done in oil well perforating, for example. Second, the spring washer exerts lateral force on the circumference of the liner in an inward direction. McVeagh states that the liner and retaining spring can substantially avoid effects of thermal contraction by axially compressing the liner against the explosive, but FIG. 6 in the McVeagh '145 patent clearly shows a gap (numeral 27) between the liner and explosive when the shaped charge is subjected to low temperature. Inward lateral force only makes the problem of thermal contraction worse, as the spring's inward force combines with the thermal contraction.

SUMMARY OF THE INVENTION

The invention is a shaped charge comprising a housing, a liner, a quantity of explosive disposed between the housing and the liner, and a retaining spring engaged with the liner and the housing. The retaining spring is positioned to retain the liner substantially immovably inside the housing and exerts axial force on the liner, in a direction substantially parallel to the discharge of the shaped charge, to prevent settling of the explosive. The retaining spring has a compressed external diameter slightly larger than diameter of the inner wall of the housing so that when compressed into the housing, the spring is prevented from moving outwardly from the housing. The compressed retaining spring also exerts force on the liner to keep it in firm contact with the explosive. The retaining spring also exerts laterally outward force against the circumference of the liner to reduce effects of thermal contraction on the liner. The bellville spring has an internal diameter substantially the same as the maximum diameter of the liner to prevent interference with discharge of the detonating shaped charge.

In a method of making a shaped charge according to the invention, a quantity of explosive is inserted into a housing, and a ram having a liner and a retaining spring in pressed into the housing so that the retaining spring retains the liner in contact with the explosive in the housing. The retaining spring exerts axial force on the liner in a direction parallel to the discharge of the shaped charge to prevent settling of the high explosive. The retaining spring also exerts laterally outward force against the circumference of the liner to reduce effects of thermal contraction on the liner.

DESCRIPTION OF THE PREFERRED EMBODIMENT

Figure 2A:
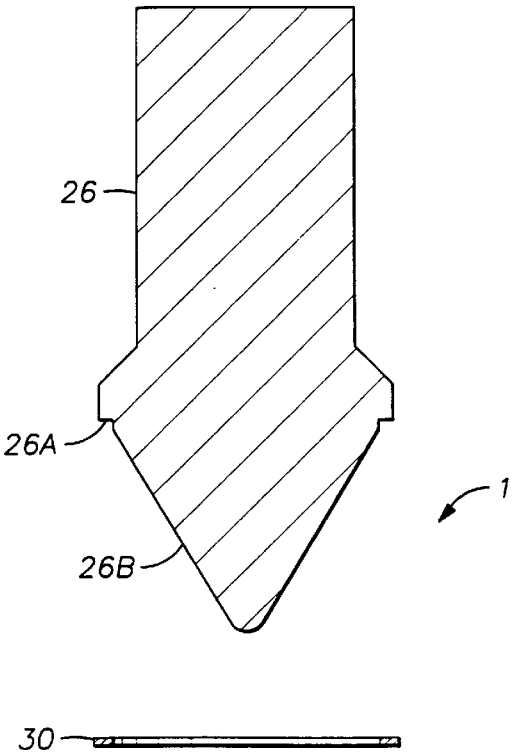
FIG. 2A shows the components of the shaped charge of the invention immediately prior to assembly.
Figure 1:
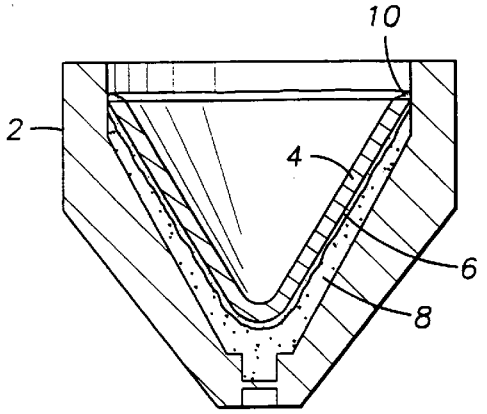
FIG. 1 (PRIOR ART)
FIG. 1 shows a cross-section of a typical prior art shaped charge.

The construction of a shaped charge 1 according to the invention can be better understood by referring to FIG. 2A. The shaped charge 1 includes a substantially cylindrically shaped charge housing 22. The housing 22 has a quantity of high explosive powder 28 disposed in the interior space. The explosive powder 28 can be of any suitable composition known in the art, such as RDX or HMX, for example. The quantity of explosive powder 28 used is related to the size and intended performance of the charge 1, as is known in the art. As is also known in the art, the housing 22 can alternatively include a quantity of accelerator explosive (not shown separately) disposed in a lower chamber 22A in the housing 22 which is positioned proximally to a detonating cord (not shown) which transmits a detonating signal to the shaped charge 1.

The shaped charge 1 also includes a liner 24, which can be substantially conically shaped and is in contact with the high explosive 28 in the assembled shaped charge 1. The liner 24 can be of any type and composition known in the art and can be formed, for example, from compression-molded powdered copper and lead, or from powdered tungsten and lead. See for example, U.S. Pat. No. 4,794,990 issued to Riggs which describes a process of compressing powdered liner material into a finished liner, and see also U.S. Pat. No. 5,567,906 issued to Reese et al. which describes improved compositions for powdered liner materials including powdered tungsten. The liner 24 preferably has an external diameter at the base of the cone very slightly smaller than the inner diameter of the housing 22 at the discharge end, to enable free movement of the liner 24 into the housing 22.

A retaining spring 30, which in this embodiment can be a bellville washer, is positioned near the base of the cone of the liner 24. The retaining spring 30 can be composed of spring steel or the like and has an internal diameter appropriate to engage the circumference of the base of the liner 24. The retaining spring 30 should have an uncompressed external diameter enabling free movement into the open end of the housing and a compressed external diameter which enables a locking fit inside the inner diameter of the housing 22. When compressed against the liner 24, the retaining spring 30 exerts axial force against the liner 24, this being in a direction along the axis of the housing 22 substantially parallel to the discharge of the detonating shaped charge 1. The axial force is transmitted through the liner 24 so that the powdered high explosive 28 remains compressed, and resists shifting and setting as the shaped charge 1 is moved about. The spring 30 is held in place laterally in the opening of the housing 22 by expansion against the inner wall of the opening in the housing 22 when compressed.

It should also be observed that the spring 30 when compressed exerts laterally outward force against the circumference of the liner 24. This laterally outward force can reduce any effects of thermal contraction of the liner 24 when the charge 1 is exposed to low ambient temperature. Furthermore, the spring 30 has an internal diameter approximately the same as the base of the liner 24. Therefore, substantially none of the spring 30 is in the path of the discharging jet since it does not substantially intrude on the inscribed cross-section of the liner 24 cone.

The spring 30 even when uncompressed extends only a very small distance (the uncompressed thickness of the spring) along the axis of the housing 22. This enables making the housing 22 so that the inner wall on which the spring 30 seats extends only a very small distance past the open end of the liner 24. By keeping the necessary extension of the housing 22 as short as possible, the shaped charge according to the invention can be used in applications, such as oil well perforating, which may require only a very small "standoff" (distance) between the target and the shaped charge.

During assembly of the shaped charge 1, the liner 24 and the retaining spring 30 can be seated on a ram 26. The ram 26 has an external surface 26B adapted to match the surface of the liner 24 disposed opposite to the powdered explosive 28. The ram 26 also has a shoulder 26A adapted to seat the retaining spring 30 and to move the spring 30 substantially axially parallel to the housing 22. The ram 26 can be forced into the housing 22 by devices such as a vacuum operated cylinder or a hydraulic cylinder (not shown), until substantially all of the inner surface of the liner 24 is in contact with the explosive 28. As the liner 24 is being pressed into contact with the explosive 28, the retaining spring 30 is also forced into contact with the inside surface of the housing 22 and the rim of the liner 24. The retaining spring 30 will be locked against the inside surface of the wall of the housing 22 because the compressed external diameter of the spring 30 is greater than the internal diameter of the housing 22, thereby effectively preventing the spring 30 from moving outwardly from the housing 22 under the shock and vibration normally encountered during transportation and handling of the shaped charge 1. The retaining spring 30 is then also in contact with the edge of the liner 24, which effectively prevents the liner 24 from moving inside the housing 22. The liner 24 is inserted into the housing 22 so as to cause the explosive 28 to contact substantially all the inside surface of the liner 24, thereby causing the explosive 28 to effectively fill all the volume between the bottom of the housing 22 and the liner 24. By filling all of the volume between the housing 22 and the liner 24, the explosive 28 is effectively prevented from moving inside the housing 22 during transportation and handling of the shaped charge 1, particularly when compressed by the axial force transmitted through the liner 24 from the spring 30.

Figure 2B:
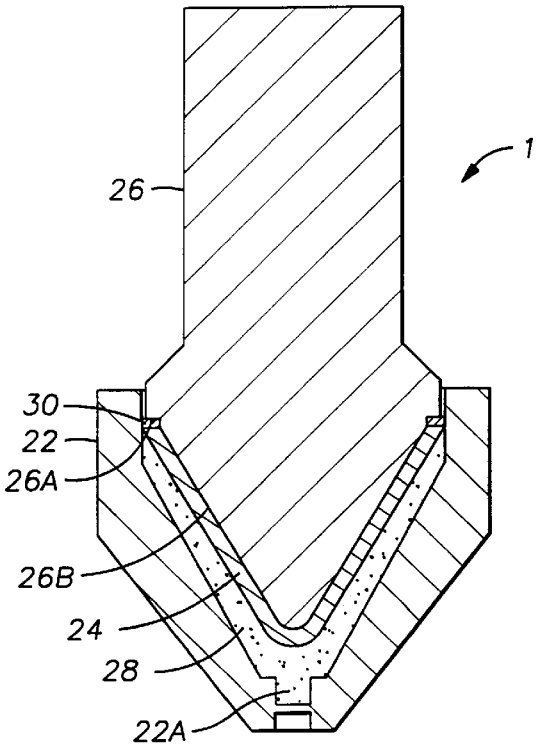
FIG. 2B shows an assembled shaped charge according to the invention.

The assembled charge 1 can be observed by referring to FIG. 2B. As can be seen in FIG. 2B, substantially all the volume behind the liner 24 above the bottom of the housing 22 is occupied by the explosive 28. After the charge 1 is assembled, the ram 26 is removed, and the shaped charge 1 can be made ready for use.

What is claimed is:

1. A shaped charge comprising:

a housing;

a liner disposed in said housing;

explosive disposed within said housing between said liner and said housing;

a retaining spring engaged with said liner and said housing, said retaining spring having a compressed external diameter enabling locking engagement with said housing, said retaining spring when compressed exerting axial force against said liner and exerting laterally outward force against a circumference of said liner.

2. The shaped charge as defined in claim 1 wherein said liner is substantially conically shaped.

3. The shaped charge as defined in claim 1 wherein said retaining spring comprises a bellville spring.

4. The shaped charge as defined in claim 1 wherein said retaining spring has an internal diameter substantially the same as a maximum diameter of said liner so that said spring does not interfere with discharge of said shaped charge when detonated.

5. A shaped charge comprising:

a housing;

a liner disposed in said housing;

explosive disposed within said housing between said liner and said housing;

a retaining spring engaged with said liner and said housing, said retaining spring having compressed external dimensions enabling locking engagement between said spring and said housing, said retaining spring when compressed exerting axial force against said liner, and having an internal diameter substantially the same as a maximum diameter of said liner so that said spring does not interfere with discharge of said shaped charge when detonated.

6. The shaped charge as defined in claim 5 wherein said liner is substantially conically shaped.

7. The shaped charge as defined in claim 1 wherein said retaining spring comprises a bellville spring.

8. The shaped charge as defined in claim 1 wherein said retaining spring when compressed exerts laterally outward force against a circumference of said liner to reduce effects of thermal contraction of said liner.

9. A shaped charge comprising:

a housing;

a liner disposed in said housing;

explosive disposed within said housing between said liner and said housing;

a retaining spring engaged with said liner and said housing, said retaining spring having a compressed external diameter enabling locking engagement with said housing, said retaining spring when compressed exerting axial force against said liner and exerting laterally outward force against a circumference of said liner, said retaining spring having an internal diameter substantially the same as a maximum diameter of said liner so that said spring does not interfere with discharge of said shaped charge when detonated.

10. The shaped charge as defined in claim 9 wherein said retaining spring comprises a bellville spring.

11. A shaped charge comprising:

a housing;

a liner disposed in said housing;

explosive disposed within said housing between said liner and said housing;

a retaining spring engaged with said liner and said housing, said retaining spring having compressed external dimensions enabling locking engagement between said spring and said housing, said retaining spring when compressed exerting axial force against said liner, and having an internal diameter substantially the same as a maximum diameter of said liner so that said spring does not interfere with discharge of said shaped charge when detonated, said retaining spring when compressed exerting laterally outward force against a circumference of said liner to reduce effects of thermal contraction of said liner.

12. The shaped charge as defined in claim 11 wherein said retaining spring comprises a bellville spring.

* * * * *